United States Patent [19]

Ishii

[11] 4,412,488

[45] Nov. 1, 1983

[54] AUTOMATIC PRINTING MACHINE

[75] Inventor: Koji Ishii, Fuchu, Japan

[73] Assignee: Ryobi Ltd., Hiroshima, Japan

[21] Appl. No.: 265,320

[22] Filed: May 20, 1981

[30] Foreign Application Priority Data

May 26, 1980 [JP] Japan ..... 55-70684

[51] Int. Cl.[3] ..... B41F 7/00

[52] U.S. Cl. ..... 101/142; 101/144

[58] Field of Search ..... 101/141-144, 101/415.1

[56] References Cited

U.S. PATENT DOCUMENTS 3,457,857 7/1969 Burger ..... 101/144
3,614,926 10/1971 Brechtel ..... 101/415.1
3,691,950 9/1972 Gates ..... 101/415.1
3,956,985 5/1976 Ishii ..... 101/144
4,178,848 12/1979 Ishii ..... 101/142

*Primary Examiner*—William Pieprz
*Attorney, Agent, or Firm*—Sughrue, Mion, Zinn, Macpeak, and Seas

[57] ABSTRACT

An automatic printing machine including an automatic plate loading device wherein a water duct mechanism is first activated after which a form roller mechanism is operated to cause form rollers to contact a plate cylinder. After this, the plate loading device forms a plate loading operation in which an original plate is satisfactorily fitted onto the plate cylinder wherein the plate surface is prevented from being contaminated by ink. Satisfactory printing results are obtained as soon as the plate is loaded onto the plate cylinder so that the first printing sheet is satisfactory and there is no waste of printing sheets.

6 Claims, 8 Drawing Figures

AUTOMATIC PRINTING MACHINE

BACKGROUND OF THE INVENTION

The present invention relates to automatic offset presses in which a series of processes from a printing process through a plate unloading process to a blanket cylinder cleaning process are automatically carried out. More particularly, the invention relates to a plate loading device, a water duct roller mechanism and a form roller mechanism in the automatic offset press.

An offset press is well known in the art in which an automatic plate loading device is provided so that an original plate is conveyed by being held between rollers and is automatically loaded onto a plate cylinder. Then, form rollers are brought into contact with the surface of the plate on a plate cylinder to coat the plate surface with printing ink and a moisture supplying solution, the ink being transferred to the image region.

In the conventional printing machine described above, for an initial period after the plate has been loaded onto the plate cylinder, the plate is not satisfactorily fitted to the plate cylinder using conventional gripper means. Accordingly, portions of the plate, other than those where it is desired to do so, are brought into portions of the plate contact with the form rollers. That is, the ink is undesirably coated onto other than the pattern region.

The portions of the plate surface undesirably coated with ink can be cleaned or the ink stains on the plate surface can be removed while the plate cylinder makes several revolutions. However, since the clearance between the plate cylinder and the rubber blanket cylinder is small, as the plate cylinder is rotated, the ink stains on the portions of the plate which are not satisfactorily fitted to the plate cylinder are brought into contact with the rubber blanket cylinder and transferred onto the cylinder. Accordingly, it is impossible to obtain a satisfactory printing result from the beginning of the printing operation. Therefore, disadvantageously, it is necessary to repeatedly carry out a test printing until a satisfactory printing result is obtained.

SUMMARY OF THE INVENTION

In view of the above-described difficulty, the invention is intended to provide an automatic printing machine with an automatic plate loading device which is so designed that, according to the invention, first the water duct roll mechanism is activated, then the form roller mechanism is operated to cause the form rollers to contact the plate cylinder. Thereafter, the plate loading device carries out the plate loading operation whereby the original plate is closely and completely fitted to the plate cylinder from the beginning thus preventing the plate surface from being contaminated. Accordingly, a satisfactory printing result is obtained with the plate loaded onto the plate cylinder beginning with the first printed sheet.

DESCRIPTION OF THE PREFERRED EMBODIMENTS

A preferred embodiment of an automatic printing machine constructed according to the invention will be described with reference to the accompanying drawings.

Figure 1:
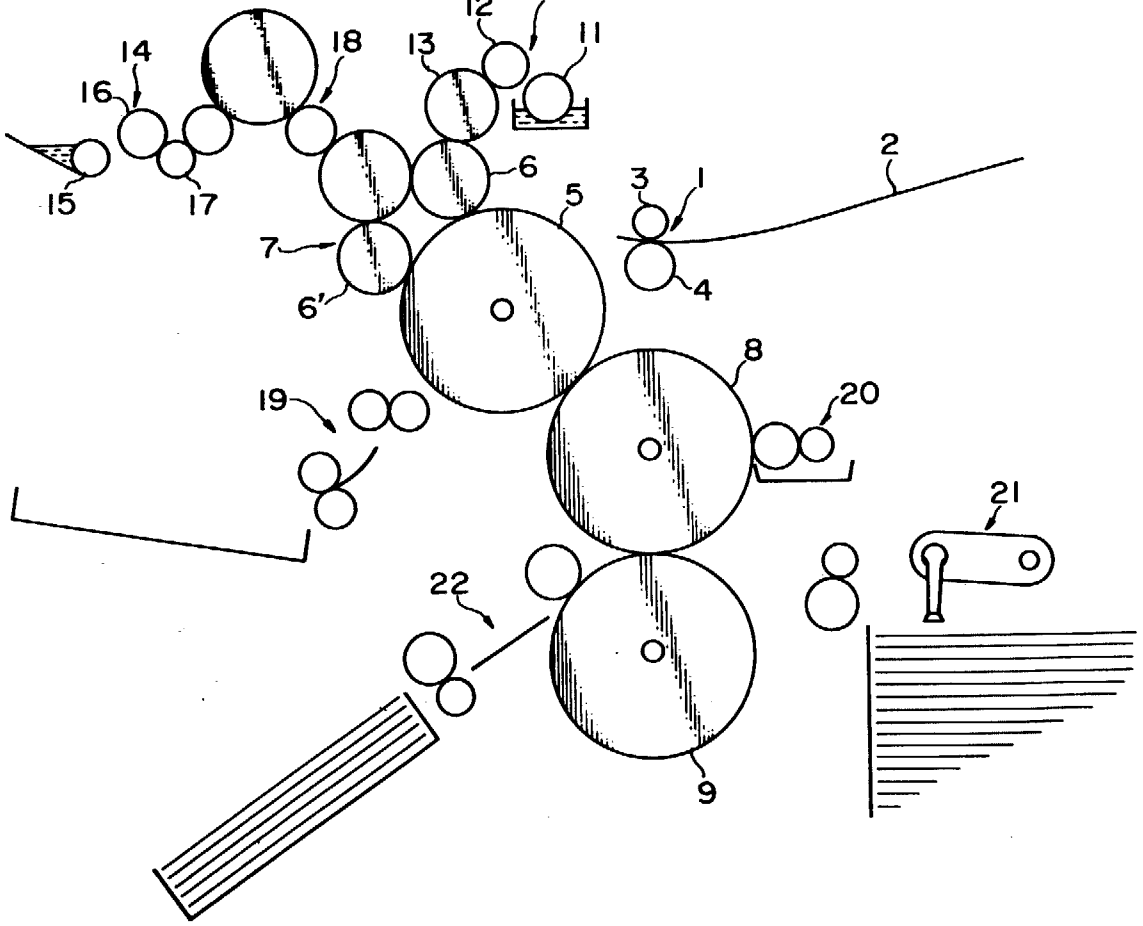
FIG. 1 is a schematic longitudinal sectional view of a preferred embodiment of an automatic printing machine according to the invention.

In FIG. 1, reference numeral 9 designates an impression cylinder; 10 a water duct roller mechanism composed of a water fountain roller 11, a water duct roller 12 and a distribution roller 13; and 14 an ink duct roller mechanism composed of a fountain roller 15, a duct roller 16 and a distribution roller 17. A plurality of ink rollers 18 are arranged between the distribution roller 17 and form rollers 6 and 6'. Further in FIG. 1, reference numeral 19 designates a plate unloading device, 20 a blanket cylinder cleaning device 21, a sheet feeding device, and 22 a sheet discharging device.

Before the plate loading operation of the plate loading device 1, the water duct roller mechanism 10 is operated after which the form roller mechanism 7 is operated to cause the form rollers 6 and 6' to contact the plate cylinder 5. Thereafter, the plate loading operation is carried out.

Figure 2:
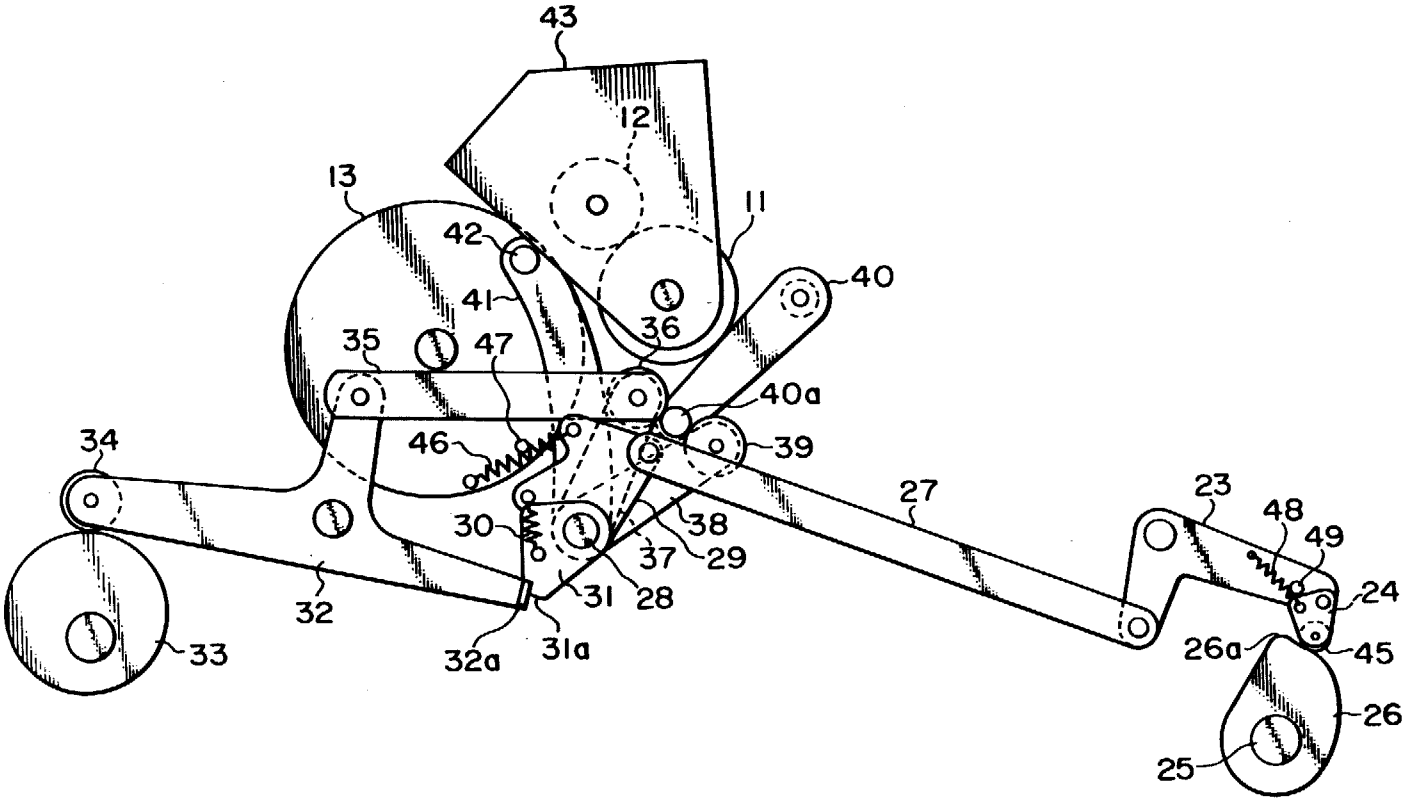
FIG. 2 is a side view of a water duct roller mechanism in the automatic printing machine.

The water duct roller mechanism 10 is operated through a cam lever 23 pivotally mounted on a frame (not shown) and a sub-lever 24 coupled to one end portion of the cam lever 23 by rotation of a cam 26 which is fixedly secured to an operating shaft 25 as shown in FIG. 2. An operating lever (described below) is fixedly secured to the operating shaft 25. A lever 29 pivotally mounted on a shaft 28 is rotatably coupled through a link 27 to the cam lever 23. A latch 31 is loosely fitted on the shaft 28 and a spring 30 is connected between the latch 31 and the lever 29 so that the latch 31 is turned as the lever 29 is turned. The engaging portion **31*a* of the latch 31 is freely movable into and out of engagement with the engaging portion 32*a* of a rotatable lever 32. Engagement and disengagement are effected as follows: When the roller 34 of the lever 32 is brought into contact with a cam 33, the rotation of the cam 33 will cause the lever 32** to pivot periodically to control the latch.

The lever 32 is coupled to a link 35 which is coupled to an arm 37 having a roller 36 thereon. The arm 37 rotatably supported on secured to the shaft 28. An arm 38 is fixedly mounted on the shaft 28 at one end and has a roller 39 at the other end. A pin **40*a* fixed to an arm 40 is interposed between the roller 39 and the abovedescribed roller 36 in such a manner that it can be freely moved back and forth. By controlling the amount of movement of th arm 40, the angular disposition of the arm 37 and shaft 28 can be changed thereby to change the angular position of an arm 41** (described below).

The arm 41 is fixedly secured to the shaft 28 at one end and has a pin 42 at the other end. The pin 42 is engaged with a frame 43 holding the water fountain roller 11 and the water duct roller 12. As the lever 32 is turned with rotation of the cam 33, the arm 41 is rocked to cause the water duct roller 12 to supply a suitable quantity of water to the distribution roller 13. In this connection, the position of the arm 40 is controlled to control the rocking position of the arm 41 thereby to adjust the contact time during which the water duct roller 12 is in contact with the distribution roller 13. FIG. 2 shows the water duct roller mechanism 10 in a stopped state with the roller 12 out of contact with the distribution roller 13.

The above-described cam 26 has a protrusion 26*a*. When the operating lever 44 is turned to the position II in FIG. 3, the sub-lever 24 is turned counterclockwise by a roller 45 pivotally mounted on the sub-lever 24 and the protrusion 26*a* of the cam 26 whereupon the lever 29 strikes a stop 47 by the elastic force of a spring 46 whereby the water duct roller 12 is operated. When the operating lever 44 turns the operating shaft 25 so that the roller 45 of the sub-lever 24 does not touch the cam 26, the sub-lever 24 is turned clockwise by the elastic force of the spring 48 until it abuts against the 49.

When the operating lever is returned to the position II after the printing operation, the lever 23 is turned counterclockwise through the sub-lever 24 by the cam 26 so that the operation of the water duct roller 12 is stopped.

After completion of the operation of the water duct roller mechanism 10, the form roller mechanism 7 is operated to cause the form rollers 6 and 6' to contact the plate cylinder 5 to apply the moisture supplying solution and the ink thereto.

Figure 5:
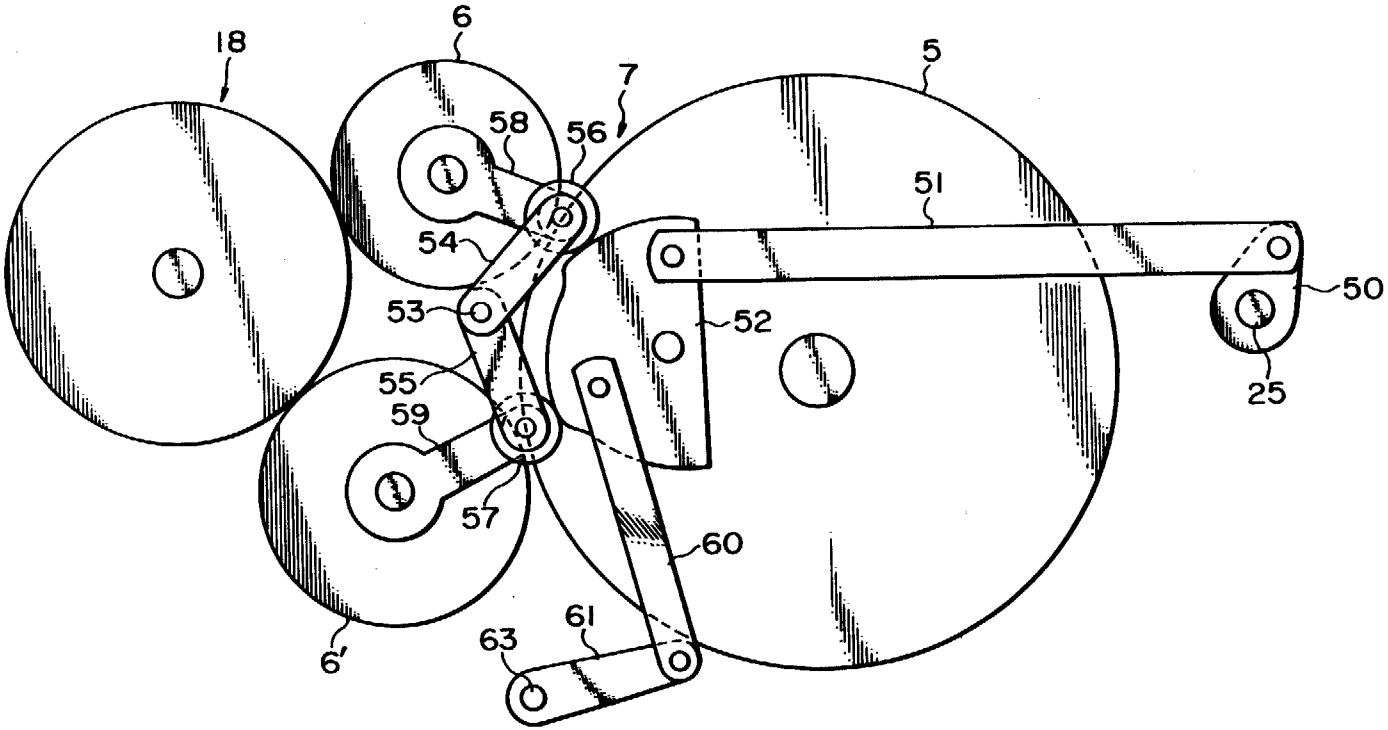
FIGS. 5 and 6 are side views of a form roller mechanism in the printing machine viewed from the operating side and the opposite side, respectively.
Figure 6:
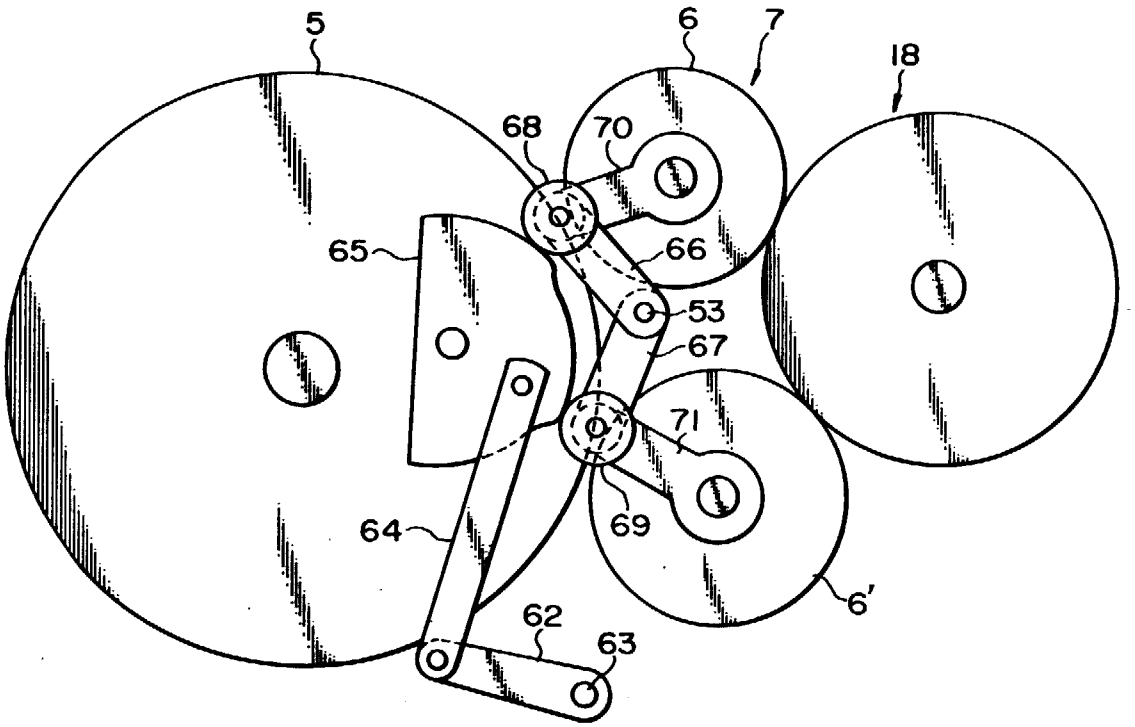

The form roller mechanism 7 is constructed as shown in FIGS. 5 and 6. An arm 50 is fixedly secured to the abovedescribed operating shaft 25. The arm 50 is coupled through a link 51 to a cam 52 in such a manner that the cam 52 is turned as the position of the operating lever 44 is changed. The rollers 56 and 57 of arms 54 and 55, which are pivotally coupled together at 53, are abutted against the cam 52. The arms 54 and 55 are pivotally coupled to arms 58 and 59 which pivotally support the form rollers 6 and 6', respectively. The cam 52 is coupled through a link 60 to an arm 61. The arm 61 is coupled through a shaft 63 to an arm 62 (FIG. 6) on the opposite side of the plate cylinder 5. The arm 62 is coupled through a link 64 to a cam 65 which is similar to the cam 52. Similarly as in the cam 52, rollers 68 and 69 pivotally mounted on arms 66 and 67, which are pivotally coupled at 53, are abutted against the cam 65, and arms 70 and 71 pivotally support the form rollers 6 and 6', respectively. As the cams 52 and 65 rotate, the form rollers 6 and 6' are brought into and out of contact with the plate cylinder 5 by the rollers 56, 57, 68 and 69 abutting against the cams 52 and 65 as the cams rotate.

Figure 3:
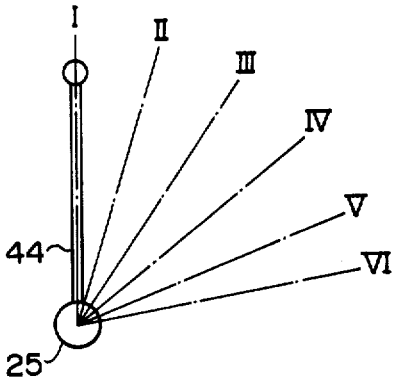
FIG. 3 is an explanatory diagram showing the operation of an operating lever in the automatic printing machine.

The operating lever 44 can be set in any of six positions as shown in FIG. 3. A series of printing operation steps are carried out by changing the position of the operating lever 44.

Figure 4:
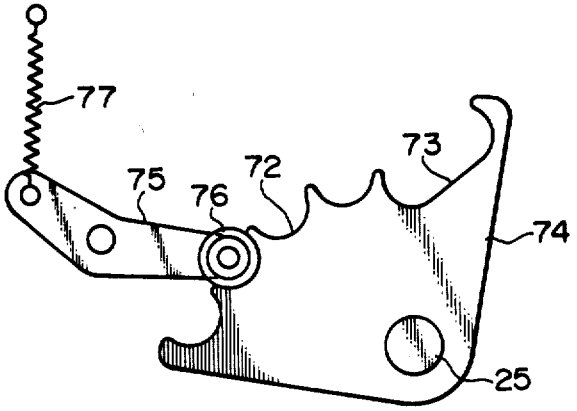
FIG. 4 is a front view of an operating lever positioning mechanism.

A mechanism for positioning the operating lever 44 is shown in FIG. 4. A set cam 74 having four engaging recesses 72 and one cam recess 73 is fixedly secured to the operating shaft 25 described above. An arm 75 having an engaging roller 76 at one end is pivotally mounted on the frame in such a manner that the engaging roller 76 is held engaged with one of the engaging recesses 72 of the set cam 74 by the elastic force of a spring 77. As the operating shaft 25 is turned by the operating lever 44, the set cam 74 is turned so that the engaging roller 76 engages with the engaging recesses 72 one after another to hold the operating lever 44 at the positions I, II, III, IV and V successively (FIG. 3). The recess 73 is so designed that, when the operator releases the operating lever 44 when it is at the position VI, the operating lever 44 can be automatically returned to the position V.

Figure 7:
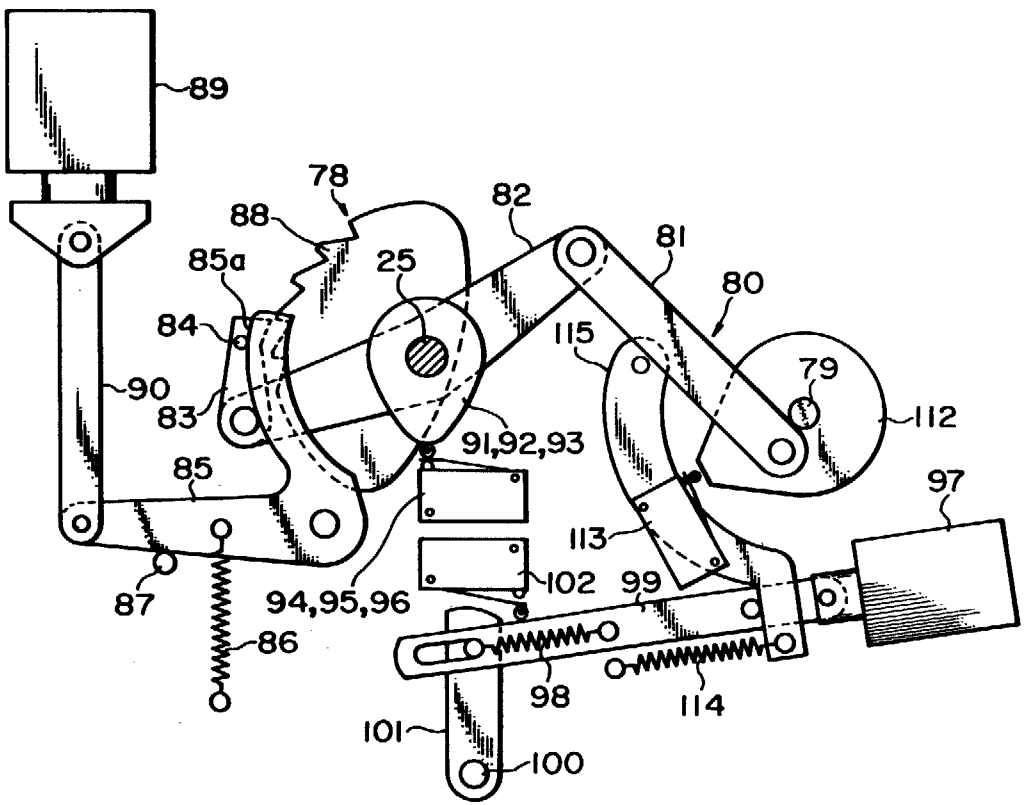
FIG. 7 is a side view of a plate loading device with an operating lever automatic returning device.

The various processes for printing are carried out by moving the operating lever 44 stepwise along the recesses 72. After the completion of a printing operation, the operating lever 44 is automatically returned from the position V through the positions IV, III and II to the position I. For this purpose, an automatic returning mechanism 78 is provided as shown in FIG. 7. An arm 82 is rocked through a link 81 by a crank mechanism 80 coupled to a rubber blanket cylinder shaft 79. A pawl 83 with a pin 84 is pivotally mounted on one end portion of the arm 82 in such a manner that the pawl 83 is reciprocated with the rocking motion of the arm 82. When the solenoid 89 is not activated prior to the completion of the printing, the pin 84 is rocked in the counter-clockwise direction by the edge 85*a* of a cam 85. As the cam is abutbed against a stop 87 by the elastic force of a spring 86, the pin 84 is maintained in the position illustrated in FIG. 7. Under this condition, the pawl 83 is disengaged from a ratchet 88 secured to operating shaft 25. When a printing completion signal is generated by a counter which performs a subtraction operation by countint sheets as they are printed, a solenoid is energized so as to turn the cam 85 through a link 90 as a result of which the pin 84 is moved downwardly to cause the pawl 83 to engage with the ratchet 88. Thus, under the condition that the pawl 83 is engaged with the ratchet 88, as the rubber blanket cylinder shaft 79 is turned, the ratchet 88, and accordingly the operating shaft 25, are turned to return the operating lever 44 stepwise.

Figure 8:
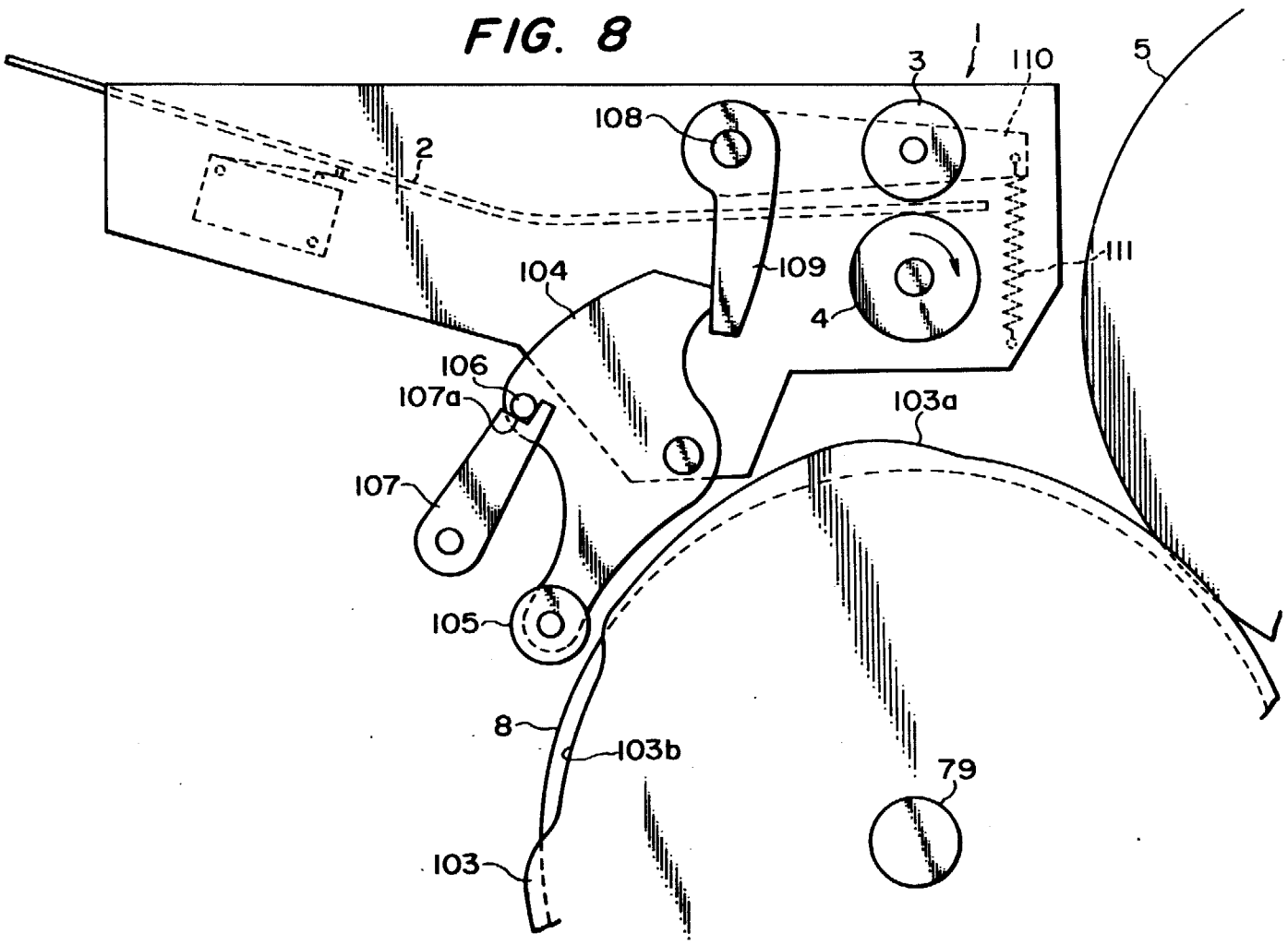
FIG. 8 is a side view of the plate loading device from the opposite direction from FIG. 7.

The plate loading mechanism 1, as shown in FIGS. 7 and 8, includes cam 91, 92 and 93 secured to the operating shaft 25 and switches 94, 95 and 96 which are positioned to be operated by the cams 91, 92 and 93. A solenoid 97 is energized by the switch 95. A link 99 is coupled to the solenoid 97. The link 99 is urged in the return direction by a spring 98. A lever 101 is coupled to the link 99 in such a manner that the lever 101 which is secured to a rod 100 is rotated by the energization of the solenoid 97 thereby to operate (open and close) a switch 102.

More specifically, the lever 101 is operated as follows: When the highest point 103*a* of a cam 103 mounted on one side of the rubber blanket cylinder 8 abuts against a roller 105 which is pivotally supported by a rotatable arm 104 to turn the arm 104 thereby to disengage the pin 106 of the arm 104 from the engaging portion 107*a* of a latch 107 which is also secured to rod 100 with the elastic force of the spring 98 in association with the operation of the solenoid, the lever 101 is operated. Arm arm 109 is rockably mounted on a shaft 108 in such a manner that it is rocked by rotation of the arm 104 when the roller 105 is engaged with the low point 103*b* of the cam 103. An arm 110 bearing the roller 3 is fixedly mounted on the shaft 108. The arms 109 and 110 are urged to turn clockwise by a spring 111 so that the roller 3 is caused to contact the roller 4 which is driven by the drive motor. Under this condition, an original plate 2 inserted between the rollers is delivered to the plate cylinder 5.

The plate cylinder 5 has conventional plate gripping means (not shown). When a plate is loaded on the plate cylinder, a switch 113 is opened by the cam 112 fixed to the rubber blanket cylinder shaft 79. The switch 113 is fixedly mounted on a lever 115 which is turned upon energization of the solenoid 97 and returned by a spring 114. Upon closure of the switch 113, the solenoid 97 is deenergized to return the lever 115 thereby to open the switch 113. When the roller 105 comes into contact with the cam 103, the pin 106 engages the latch 107 so that the roller 3 is moved away from the roller 4 thus stopping the plate loading operation. In this operation, when the switch 102 is closed by the solenoid 97, a solenoid (not shown) for operating a gripper mechanism (not shown) is operated.

The above-described water duct roller mechansim 10, form roller mechanism 7 and plate loading device 1 are activated in association with the operating shaft 25 as follows:

When the operating lever 44 is at the position I, the neutral position as shown in FIG. 3, all mechanical operations are in a stopped state. When the operating lever 44 is shifted to the position II, the drive motor (not shown) of the printing machine is operated by the switch 94 so that water is supplied from the water duct roller 12 to the disbribution roller 13 and then from the distribution roller 13 to the form roller 6. When the operating lever 44 is shifted to the position III from the position II, first the form roller mechanism 7 is activated to cause the form rollers 6 and 6' to contact the plate cylinder 5. Then, the plate loading device 1 is operated by the switch 95 with a time delay, starting from the operation of the form roller mechanism 7, to carry out the plate loading operation and the pump motor (not shown) to provide suction for sheet feed device 21 is also operated for preparation of the sheet feeding operation. Thereafter, the operating lever is set at the position IV to force the plate cylinder 5 to contact the rubber blanket cylinder 8 in order to carry out the transferring operation.

When the operating lever is moved through the position V to the position VI, the sheet feeding mechanism 21 is activated to feed printing sheets. If, in this case, the operating lever is released, it will automatically return to the position V so that the printing operation can be carried out. Upon completion of the printing operation, the operating lever 44 is returned by the operating lever returning mechanism 78. When the operating lever 44 returns to the position III, the form rolls 6 and 6' are moved away from the plate surface. When the operating lever 44 reaches the position II, the plate unloading operation and the blanket cylinder cleaning operation are started by the switch 96. With the operating lever 44 at the position II, the operation of the water duct roll mechanism 10 is stopped. When the lever 44 is returned to the position I, all driving operations are halted.

As is clear from the above description, in the automatic printing machine according to the invention, before a plate is loaded onto the plate cylinder 5, the water duct roll mechanism 10 is operated after which the form duct roller mechanism is activated to cause the form rollers to contact the plate cylinder 5. That is, the plate loading operation is effected after the form rollers 6 and 6' have been brought into contact with the plate cylinder 5. Therefore, the contact pressure of the form rollers 6 and 6' causes the original plate 2 to be satisfactorily fitted onto the plate cylinder 5 from the beginning of the loading operation. Accordingly, only the pattern region of the plate can be coated with ink by the form rollers 6 and 6' from the beginning of the printing operation. Even if ink is applied to the plate cylinder 5 before a plate is loaded and the plate is loaded before the ink is removed, the ink applied outside the plate is removed by the form rollers 6 and 6'. Accordingly, if, after ink other than that in the pattern region has been removed, the ink on the pattern region is transferred onto the rubber blanket cylinder 8, the printing operation will be satisfactorily carried out beginning with the first printing sheet after the original plate has been loaded on the plate cylinder.

The form rollers 6 and 6' are brought into contact with the plate cylinder 5 in a manner described above. The water duct roller mechanism 10 is activated to supply water before the form rollers 6 and 6' come into contact with the plate cylinder 5 while the surface of the plate cylinder 5 is hydrophilic, and accordingly inking the surface of the plate cylinder is difficult. Thereofore, there will be little if any contamination with ink of the portion of the plate cylinder which is exposed outside the original plate. However, if any contamination occurs, the ink will be readily and positively removed by the form rollers 6 and 6' so that troublesome ink stains on the plate cylinder are entirely eliminated. Accordingly, the printing operation is carried out satisfactorily beginning with the first printing sheet.

Even if ink is applied to the plate cylinder 5 when the form rollers 6 and 6' contact the plate cylinder 5, such ink will be removed by the form rollers 6 and 6' after the latter have made several revolutions. If the plate is loaded on the plate cylinder 5 thereafter, the above-described advantageous effect will be similarly obtained because, in this case, the rear side of the plate will not be contaminated with ink and the portion of the plate cylinder which is exposed outside the plate will not be stained with the ink. This can be achieved by applying a plate loading signal to the solenoid 97 through a counter or a timer by opening the switch 95.

What is claimed is:

1. An automatic printing machine comprising plate loading device for delivering a printing plate onto a plate cylinder;

an operating shaft;

an operating lever rigidly coupled to said operating shaft and movable sequentially to a plurality of operating positions;

a plurality of cams provided on said operating shaft;

said plate loading device, a water duct roller mechanism and a form roller mechanism being operatively coupled to said operating shaft and said cams in such a manner that said plate loading device, water duct roller mechanism and form roller mechanism are operated as said operating shaft is turned;

said cams each having a shape and orientation relative to each other and said shaft so that, as said operating lever is turned from a first neutral position to a second position said water duct roller mechanism is activated, as said operating lever is turned to a third position said form roller mechanism is activated to cause form rollers to contact said plate cylinder, and then said plate loading device is activated to perform a plate loading operation.

2. The printing machine of claim 1 wherein said operating lever and operating shaft have positions I through VI, at least first and second cams being provided on said operating shaft; and further comprising first and second switches, said first switch being coupled to activate a drive motor of said printing machine and said second switch being coupled to activate a plate loading operation and to activate a pump motor for a sheet feeding operation; wherein, in said position I, all mechanical operations of said printing machine are in a stopped state; in said position II, said first cam operates said first switch to activate said drive motor, wherein water is supplied from a water duct roller to a distribution roller and then a form roller; in said position III, said form roller mechanism is activated to cause form rollers to contact said plate cylinder after which said second cam operates said second switch to activate a plate loading operation and to activate said pump motor; in said position IV, said plate cylinder is forced into contact with a rubber blanket cylinder; in said position V, a printing operation is performed; and, in said position VI, a sheet feeding mechanism is activated, said lever being moveable directly from position IV to position VI and then back to position V.

3. The printing machine of claim 1 wherein said operating lever further comprises a set cam fixedly secured to said operating shaft, said set cam having a plurality of engaging recesses and a cam recess larger than said engaging recesses formed therein; a lever pivotally mounted at a center position thereof, said lever having an engaging roller rotatably disposed at one end thereof position to engage and said engaging recesses; and a spring for rotatably biasing said lever to urge said engaging roller into engagement with said engaging recesses.

4. The printing machine of claim 3 wherein said plate loading device comprises first through third cams secured to said operating shaft; first through third switches disposed to be operated by said first through third cams, respectively; a solenoid; a link slidably coupled to said solenoid; a spring for urging said link in a return direction; a first rod; a first lever fixedly coupled to said first rod at one end of said first lever, said first lever having a pin rigidly coupled to a second end thereof, said pin being slidably disposed in a slot in said link, said spring for urging said link in said return direction having one end coupled to said pin and the other end coupled to said lever; a latch rigidly coupled to said first rod; a rotatable first arm having a pin rigidly coupled thereto positioned to be engaged with said latch, said first arm having a roller on one end thereof; a fourth cam coupled to rotate with said rubber blanket cylinder, said roller of said first arm following said fourth cam; a second rod and second and third arms rigidly mounted on said second rod for rotation therewith, one end of said second arm being disposed to abut an end of said first arm; a spring for urging said second arm into abutment with said first arm; a first feed roller rotatably mounted on said third arm; a second feed roller disposed opposite said first roller and coupled to a drive motor for rotation, said first and second feed rollers adapted to transport a printing plate to said plate cylinder; a second lever, an automatic returning mechanism for said second lever, a fifth cam rigidly coupled to said rubber blanket cylinder to rotate therewith; a fourth switch having an actuating member disposed to be actuated by said first lever and a fifth switch mounted on said second lever having an actuating member disposed to be actuated by said fifth cam for terminating operation of said feed rollers and activating a plate gripping means on said plate cylinder.

5. The printing mechine of claim 1 wherein said form roller control mechanism comprises a first arm rigidly coupled to be rotated with said operating shaft; first and second similar cams disposed adjacent opposite ends of a plate cylinder; a first link coupled between one end of said first arm and said first cam; a second arm pivotally mounted to a first end of a first form roller; a third arm pivotally mounted to a first end of a second form roller; first and second rollers coupled to ends of said second and third arms, respectively and disposed to abut said cam; a fourth arm having one end rotatably coupled to said end of said second arm; a fifth arm having one end rotatably coupled to said end of said third arm, said fourth and fifth arms having second ends rotatably coupled together; a sixth arm rotatably coupled one end to said first cam; a seventh arm having one end rotatably coupled to a second end of said sixth arm; a rod, said seventh arm having a second end rigidly coupled to said rod; an eighth arm having a first end rigidly coupled to said rod; a second link having one end rotatably coupled to a second end of said eighth arm and a second end rotatably coupled to said second cam; a ninth arm pivotally mounted to a second end of said first form roller; a tenth arm pivotally mounted to a second end of said second form roller; third and fourth rollers coupled to ends of said ninth and tenth arms, respectively, and disposed to abut said second cam; an eleventh arm having one end rotatably coupled to said end of said ninth arm; and a twelfth arm having one end rotatably coupled to said end of said tenth arm and a second end rotatably coupled to a second end of said eleventh arm.

6. The printing machine of claim 1 wherein said water duct roller control mechanism comprises a first cam fixed to said operating shaft, said first cam having a protrusion formed thereon; a sub lever having a roller at one end thereof disposed to ride upon said first cam; a rotatably mounted first lever having said sub lever rotatably mounted at one end thereof; a first spring coupled between said sub lever and said first lever; a first link having a first end rotatably coupled to a second end of said first lever; a shaft; a second lever pivotally mounted on said shaft; a first arm fixed to said shaft, a second end of said first link being rotatably coupled to said second lever; a stop disposed adjacent a side of said second lever opposite said first link and a second spring for urging said second lever toward said stop; a second arm fixed to said shaft; a latch loosely fitted on said shaft; a third spring coupled between said latch and said second lever; a third lever rotatably mounted, said third lever having an engaging portion adapted to engage with said latch in a predetermined operative position thereof; a second cam having a different rotational ratio than a plate cylinder; a first roller rotatably mounted on a second end of said third lever disposed to ride on said second cam; a second link having a first end rotatably coupled to a third end of said third lever and a second end rotatably coupled to a second end of said first arm; a second roller rotatably coupled to said second end of said first arm; a third roller rotatably coupled to a second end of said second arm; a third arm rotatably mounted at one end thereof and having a first pin ridigly coupled to a second end thereof, said first pin being disposed between said first and second rollers and urging said first and second rollers apart from one another; a frame; a duct roller and a fountain roller rotatably mounted on said frame; a fourth arm fixed to said shaft at one end thereof; a second pin rigidly coupled to a second end of said fourth arm and abutting and edge of said frame, wherein movement of said third arm controls an angle between said first and second arms to vary a rocking position of said fourth arm and wherein rotation of said second cam causes said duct roller to contact a distribution roller to supply water to said distribution roller.

* * * * *